United States Patent [19]

Uematu

[11] Patent Number: 4,866,749

[45] Date of Patent: Sep. 12, 1989

[54] X-RAY GENERATOR SELECTIVELY PROVIDING POINT- AND LINE-FOCUSING X-RAYS

[75] Inventor: Hideaki Uematu, Tokyo, Japan

[73] Assignee: Rigaku Denki Kabushiki Kaisha, Tokyo, Japan

[21] Appl. No.: 228,406

[22] Filed: Aug. 5, 1988

[30] Foreign Application Priority Data

Aug. 17, 1987 [JP] Japan ..... 62-124620[U]

[51] Int. Cl.[4] ..... H01J 35/06

[52] U.S. Cl. ..... 378/134; 378/136

[58] Field of Search ..... 378/134–138, 378/121, 146

[56] References Cited

U.S. PATENT DOCUMENTS 3,631,289 12/1971 Perry et al. ..... 378/136

FOREIGN PATENT DOCUMENTS 0093536 5/1986 Japan ..... 378/136

0857416 12/1960 United Kingdom ..... 378/134

*Primary Examiner*—Janice A. Howell

*Assistant Examiner*—Joseph A. Hynds

*Attorney, Agent, or Firm*—Sughrue, Mion, Zinn, Macpeak and Seas

[57] ABSTRACT

An X-ray is generated when thermoelectrons emitted from a cathode impinge upon an anode, and the X-ray thus generated is taken out from a window. The cathode has a surface formed with two grooves intersecting at a right angle with each other and two coil filaments are fitted thereinto. By selectively heating one of the two coil filaments, a region on the anode upon which the thermoelectrons impinge is changed, whereby one of point- and line-focusing X-rays is selectively taken out from the window provided at a portion slightly below the face of the anode and at a wall of a casing of an X-ray tube.

4 Claims, 2 Drawing Sheets

X-RAY GENERATOR SELECTIVELY PROVIDING POINT- AND LINE-FOCUSING X-RAYS

BACKGROUND OF THE INVENTION

The present invention relates generally to an X-ray generator, and more particularly to an improvement of an X-ray generator providing point- and line-focusing X-rays.

An X-ray generator has been used for various purposes, one of which is to use it in conjunction with an X-ray diffractograph or a diffractometer to analyze, for example, a crystal structure of a substance. The crystal structure is analyzed by irradiating an X-ray onto the substance and measuring a diffraction angle of the X-ray reflected from or passed through the substance. In this analysis, a point- or a line-focusing X-ray is selectively used.

Four windows are typically provided in the periphery of an X-ray tube with a displacement by 90 degrees from one another, in which two diametrically opposite windows are for providing point-focusing X-rays and the remaining two windows which are also disposed in diametrically opposite positions are for providing line-focusing X-rays. The point- and the line-focusing X-rays are taken out of different windows displaced by 90 degrees, so that when the analysis mode is changed from that using the point-focusing X-ray to that using line-focusing X-ray, or vice versa, the position of an attachment to the X-ray tube, such as the X-ray diffractograph, has to be moved. Alternatively, the X-ray tube has to be rotated by 90 degrees while leaving the position of the attachment unchanged. Such an X-ray generator is disadvantageous in that a large space has to be reserved around the installation position of the X-ray generator for the attachment. Otherwise, a rotating mechanism needs to be provided for rotating the X-ray tube. In the latter case, the operation of the rotating mechanism is intricate and fine adjustment of positioning the attachment is difficult.

SUMMARY OF THE INVENTION

The present invention has been made in view of the foregoing disadvantages, and accordingly, it is an object of the invention to provide an X-ray generator in which switching between a point- and a line-focusing modes of an X-ray can be achieved quite easily and quickly.

In order to achieve the foregoing and other objects, the X-ray generator according to the invention comprises an X-ray tube for radiating an X-ray, the X-ray tube comprising a cathode and an anode, wherein the cathode includes thermoelectron generating means for generating thermoelectrons when heated and has a surface formed with two grooves intersecting at a right angle with each other, the thermoelectron generating means being fitted into the grooves, and wherein the surfaces of the cathode is disposed to confront the anode and the thermoelectrons generated from the thermoelectron generating means impinge upon the anode, whereupon the anode generates an X-ray; and a switching means for selectively heating the the thermoelectron generating means in one of the two grooves.

BRIEF DESCRIPTION OF THE DRAWINGS

In the drawings:

FIGS. 6A and 6B are diagrams for description of the operation of the present invention, wherein FIG. 6B is a cross-sectional view taken along the lines VI—VI of FIG. 6A.

DETAILED DESCRIPTION OF THE PREFERRED EMBODIMENTS

Figure 1:
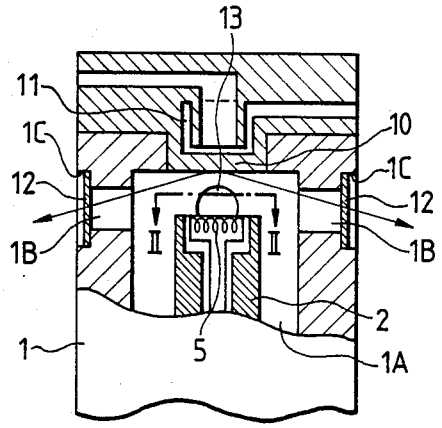
FIG. 1 is a cross-sectional view showing an essential portion of an X-ray tube according to one embodiment of the invention.
Figure 2:
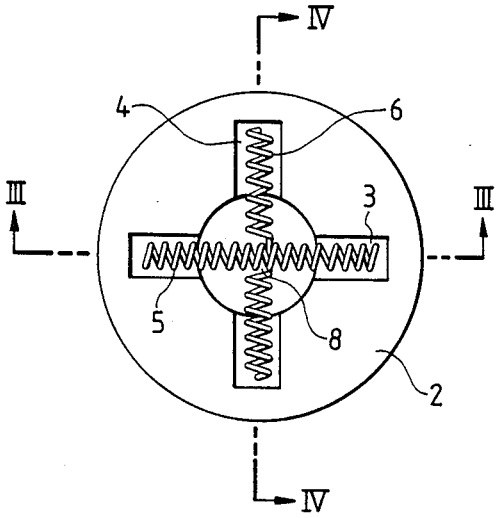
FIG. 2 is an enlarged cross-sectional view taken along the line II—II of FIG. 1.
Figure 3:
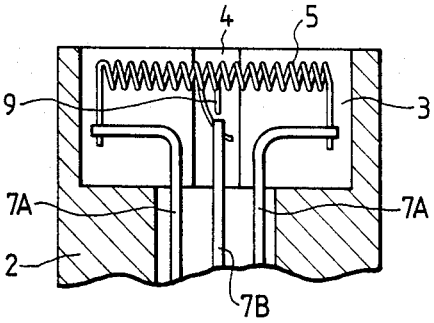
FIGS. 3 and 4 are cross-sectional views taken along the lines III—III and IV—IV of FIG. 2.
Figure 4:
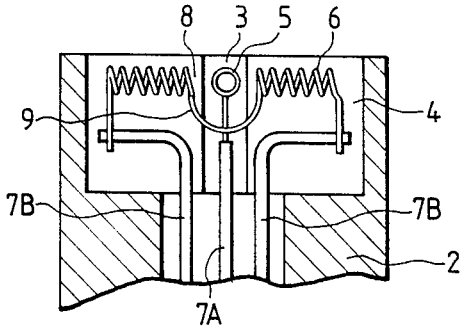

An X-ray tube according to a preferred embodiment of the present invention is constructed as shown in FIG. 1, in which a cylindrically shaped cathode 2 is disposed within an interior of a fluid-tight metal casing 1 in the form of a polygon-pillar in a coaxial relation with each other. As shown in FIG. 2, the cathode 2 has one end face formed with grooves 3 and 4 linearly extending in radial directions which intersect at a right angle with each other. In the grooves 3 and 4, coil filaments 5 and 6 are fitted, respectively. The coil filament 5 is linearly or straightly extending along the groove 3. Another coil filament 6 is substantially straightly extending along the groove 4, but has a downwardly protruded segment 9 at its central portion which while preserving continuity of the coil filament 6, prevents the coil filament 6 from contacting another coil filament 5 at the intersecting portion. Conductors 7A and 7B are connected to both ends of each of the coil filaments 5 and 6, and the coil filaments 5 and 6 are thereby floatingly supported. Free end terminals of those conductors 7 are taken externally out of the casing 1.

An anode or target 10 is disposed so as to confront the end face of the cathode 2 with a predetermined spacing therebetween. The anode 10 is made of, for example, copper, and has a circular planar face in the portion where it confronts the cathode 2. A passageway 11 is formed in the interior of the anode 10 for allowing cooling water to flow thereinto, to thus cool the anode 10.

Figure 5:
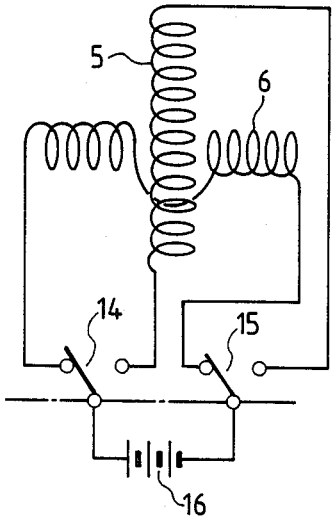
FIG. 5 is a circuit diagram showing a connection of a power source to coil filaments.

Four circular windows 12 and 13 are provided at positions slightly below the planar face of the anode 10, and at the wall of the casing 1. More specifically, the casing 1 defines therein an internal chamber 1A in which the cylindrical cathode 2 is disposed. The casing 1 is formed with four passageways 1B in communication with the internal chamber 1A. These passageways 1B extend in radial directions of the cathode 2 and completely extend through the wall of the casing 1. Further, recesses 1C are formed in alignment with the passageways 1B. Each of the recesses 1C is in communication with each of the radially outer end portions of the passageways 1B, and windows 12 and 13 are disposed in the corresponding recesses. The positions of the windows are displaced by 90 degrees from one another. Two windows provided in diametrically opposite positions are denoted by the same reference numerals 12 or 13. The vertical positions of the windows 12 and 13 are such that the centers of the windows are slightly lower than a horizontal extension line of the anode face. More specificaly, the windows 12 and 13 are provided so that an X-ray take-off angle through the window is approximately 6 degrees with respect to the face of the anode 10. Beryllium plate is employed for those windows, since beryllium is excellent in X-ray transmission property. A shutter (not shown) is provided to cover each of the windows for interrupting the X-ray from being leaked out when the X-ray is not used, and is opened only when the X-ray is used. As shown in FIG. 5, ganged switches 14 and 15 are provided, with which one of the coil filaments 5 and 6 are selectively energized by a battery 16.

In operation, when the coil filament 5 is connected to the battery 16 through the switches 14 and 15, the coil filament 5 is heated and thermoelectrons are emitted therefrom. The grooves 3 and 4 serve as converging electrode for converging the thermoelectrons in the widthwise direction of the groove, i.e. in the direction perpendicular to the longitudinal direction of the groove. The thermoelectrons are accelerated to a high speed due to a high voltage difference between the cathode 2 and the anode 10, and impinge upon the anode 10. In an anode grounded type, a high negative voltage is applied to the cathode with the anode being grounded.

Figure 6A:
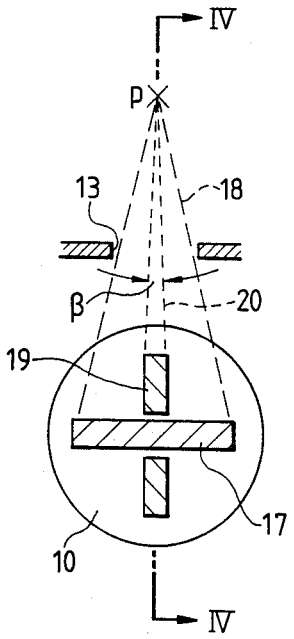

FIG. 6A is a diagram showing the anode 10 viewed from the cathode side. The thermoelectrons impinge upon the portion of the anode 10 indicated by oblique lines 17 (which portion is referred to as "a real focus"), from which the X-ray is generated. The length of the coil filaments, the size of the grooves, and the distance between the cathode 2 and the anode 10 are determined so that the size of the real focus on the anode 10 is, for example, $1\times10$ mm$^2$. A line-focusing X-ray can be taken out of the window 13 which is disposed in parallel with the longitudinal direction of the coil filament 5. The line-focusing X-ray thus taken out has a cross-section of about $0.1\times10$ mm$^2$ (which is referred to as "an effective focus"), because the widthwise dimension of the real focus X-ray is reduced to about one tenth when viewed from an incident point P at a glancing angle or take-off angle of 6 degrees.

Figure 6B:
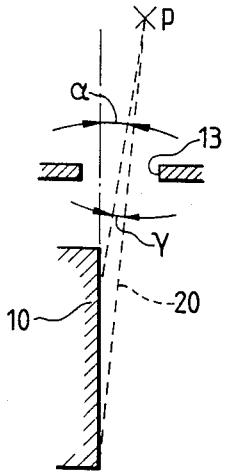

When the coil filament 6 is connected to the battery 16 by switching the ganged switches 14 and 15, the thermoelectrons impinge upon the portion of the anode 10 indicated by oblique lines 19. In this case, a point-focusing X-ray having a cross-section of $1\times1$ mm$^2$ can be taken out of the same window 13 which is disposed perpendicular to the longitudinal direction of the coil filament 6, because the glancing angles and are small. Through the window 13, the X-ray generating portion 19 on the anode 10 can be seen from the incident point P as indicated by dotted lines 20 in FIG. 6B.

As described, since the X-ray generator according to the invention is capable of changing the point-focusing mode to the line-focusing mode, or vice versa, a large space does not need to be reserved around the X-ray tube for installation of an attachment. Further, the X-ray tube does not need to be rotated whenever such a mode change is performed.

In the above-described embodiment, although the coil filaments are arranged to intersect with each other, it would be apparent to those skilled in the art that the same effect can be attained by arranging the coil filament in L-shaped or T-shaped.

What is claimed is:

1. An X-ray generator comprising:

an X-ray tube for radiating X-rays, said X-ray tube comprising a cathode and an anode, wherein said cathode includes thermoelectron generating means for generating thermoelectrons when heated and has a surface formed with two grooves intersecting at a right angle with each other, said thermoelectron generating means being fitted into said grooves, and wherein said surface of said cathode is disposed to confront said anode and said thermoelectrons generated from said thermoelectron generating means impinge upon said anode, whereupon said anode generates X-rays; and a switching means for selectively heating said said thermoelectron generating means in one of said two grooves.

2. An X-ray generator as defined in claim 1, wherein said thermoelectron generating means comprises two coil filaments electrically isolated from each other, and a battery means, wherein each of said two coil filaments is heated and emits said thermoelectrons when connected to said battery means.

3. An X-ray generator as defined in claim 2, wherein said switching means selectively connects said battery means to one of said two coil filaments.

4. An X-ray generator as defined in claim 3, wherein said two coil filaments are arranged so as to intersect at a central portion of each of said two coil filaments.

* * * * *